United States Patent [19]

Hoffman et al.

[11] 4,415,273

[45] Nov. 15, 1983

[54] MICROPROCESSOR DRIVEN DIGITAL DISPLAY ALARM CLOCK

[75] Inventors: Harald Hoffman, Konigstein; Lothar Pacher, Mainz, both of Fed. Rep. of Germany; Peter Busch, Fenin, Switzerland; Dan C. Raducanu, Bad Soden, Fed. Rep. of Germany

[73] Assignee: Braun Aktiengesellschaft, Kronberg, Fed. Rep. of Germany

[21] Appl. No.: 233,617

[22] PCT Filed: May 29, 1980

[86] PCT No.: PCT/DE80/00076

§ 371 Date: Jan. 27, 1981

§ 102(e) Date: Jan. 27, 1981

[87] PCT Pub. No.: WO80/02753

PCT Pub. Date: Dec. 11, 1980

[30] Foreign Application Priority Data

Jun. 2, 1979 [DE] Fed. Rep. of Germany ..... 2922621

[51] Int. Cl.[3] ..... G04B 23/02; G04B 1/00; G04C 3/00

[52] U.S. Cl. ..... 368/74; 368/267; 368/204; 368/68

[58] Field of Search ..... 368/72, 74, 250, 251, 368/68, 82, 203, 204, 220, 111, 262, 263, 240, 29, 239

[56] References Cited

U.S. PATENT DOCUMENTS

| | | | |
|---|---|---|---|
| 3,714,867 | 2/1973 | Dargent | 58/50 R |
| 3,992,873 | 11/1976 | Await | 368/68 |
| 4,228,645 | 10/1980 | Nomura | 368/250 |
| 4,277,840 | 7/1981 | Sekiya et al. | 368/74 |

FOREIGN PATENT DOCUMENTS

| | | | |
|---|---|---|---|
| 2459937 | 5/1976 | Fed. Rep. of Germany | 368/239 |
| 2530341 | 9/1976 | Fed. Rep. of Germany . | |
| 2528502 | 9/1978 | Fed. Rep. of Germany . | |
| 2544472 | 4/1977 | Fed. Rep. of Germany . | |
| 2628885 | 1/1978 | Fed. Rep. of Germany . | |
| 2628141 | of 0000 | Fed. Rep. of Germany . | |
| 2645744 | of 0000 | Fed. Rep. of Germany . | |
| 2821660 | of 0000 | Fed. Rep. of Germany . | |
| 7523854 | of 0000 | Fed. Rep. of Germany . | |
| 7812099 | of 0000 | France . | |
| 54-14273 | 2/1979 | Japan | 368/72 |

OTHER PUBLICATIONS

10 Function Digital Clock, Radio Electronics, vol. 48, No. 9, Sep. 72, Mazur.

Gas Discharge Alarm Clock, Radio Electronics, vol. 47, No. 11, 11/76, Emerald.

Electronic Clock in Alarm Call Radio, Radio Mentor Electronic (German), vol. 40, No. 6, pp. 243–245, Jun. 74.

TMS 1000 Series Data Manual, 1976, Texas Instruments.

Fluorescent Digital Clock Display Device, Futaba Corporation TD-7677d Mar. 1977, Technical Information Japan.

Fluorescent Digital Clock Display Device, TD7669e, Jan. 77, Tenative Specification, Futaba Corp. Japan.

"Uhreutechnik" article, apearing in Goldschmiede-Zeitung, 1974, Heft 5, Seite 88.

*Primary Examiner*—Bernard Roskoski

*Attorney, Agent, or Firm*—Robert A. Shack

[57] ABSTRACT

A microprocessor-based clock which has both a current time digital display and an alarm time digital display, as well as controls for setting both the current time and the alarm time either ahead or backward at selectable rates such that a single knob provides rapid setting of the setting time and a single knob provides rapid setting of the alarm time. An improved regulating circuit provides the microprocessor with a first substantially constant DC voltage and a second DC voltage limited to a given magnitude. User-accessable controls are provided for effecting a snooze alarm function, alarm setting and for disarming the alarm function for a relatively long period of time, e.g., for 24 hours. One of the controls includes strips bridgable by a conductive member such as a finger.

10 Claims, 13 Drawing Figures

MICROPROCESSOR DRIVEN DIGITAL DISPLAY ALARM CLOCK

BACKGROUND OF THE INVENTION

1. Field of the Invention

This invention relates to a clock with a digital time display.

2. Description of the Prior Art

Clocks have already been proposed which can display successively both the time and date in digital form (German Pat. No. 2,528,502, German Offenlegungsschrift 2,530,341, German Pat. No. 2,544,472). These clocks always normally display the time in hours, minutes, and possibly in seconds as well, while pressing a button displays the data instead of the time. These known clocks also permit establishing an alarm setting and initiating a snooze alarm cycle, whereby the button used to initiate the snooze alarm cycle is also used to display the alarm setting (German Offenlegungsschrift 2,544,472). Optical display of the alarm setting has been found to be highly advantageous in practice, since it is very difficult, when alarm settings change frequently, to determine what the alarm setting is.

However, the known display also suffers from the disadvantage that the alarm setting must be called up by pressing a button. Since the button is relatively small, it can only be found with difficulty in the darkness. Hence, it can happen that the user of a digital alarm clock, awaking at night or early in the morning, and wanting to know the time at which the alarm is to go off, cannot find the button in the darkness.

In order to eliminate this disadvantage, another digital clock has already been proposed which incorporates a device in the clock housing which is located at a predetermined angle to the horizontal base, and comprises a cavity wherein a ball can run along an axis, with electrical contacts being provided at one end of this cavity, said contacts being connectable with one another electrically by the ball (German Offenlegungsschrift 2,638,885).

In this known clock, the alarm setting can be displayed in simple fashion by picking up the clock and tilting it to a certain angle. The disadvantage of this arrangement is that a switch must still be operated to display the alarm setting. This disadvantage arises from the fact that only one display is provided, showing the time and the alarm setting in succession. This double function of the display also usually makes it a tedious process to set both the time and the alarm.

Hence, the goal of a invention is to provide a clock wherein both the time and the alarm setting can be displayed and adjusted in a simple fashion.

The advantage achieved with the invention consists generally in the fact that the alarm setting is always apparent and readily adjustable. Moreover, the clock according to the invention has a very simple design because it uses a microprocessor.

BRIEF DESCRIPTION OF THE DRAWINGS

The drawing shows one embodiment of the invention, described in greater detail hereinbelow.

Figure 8:
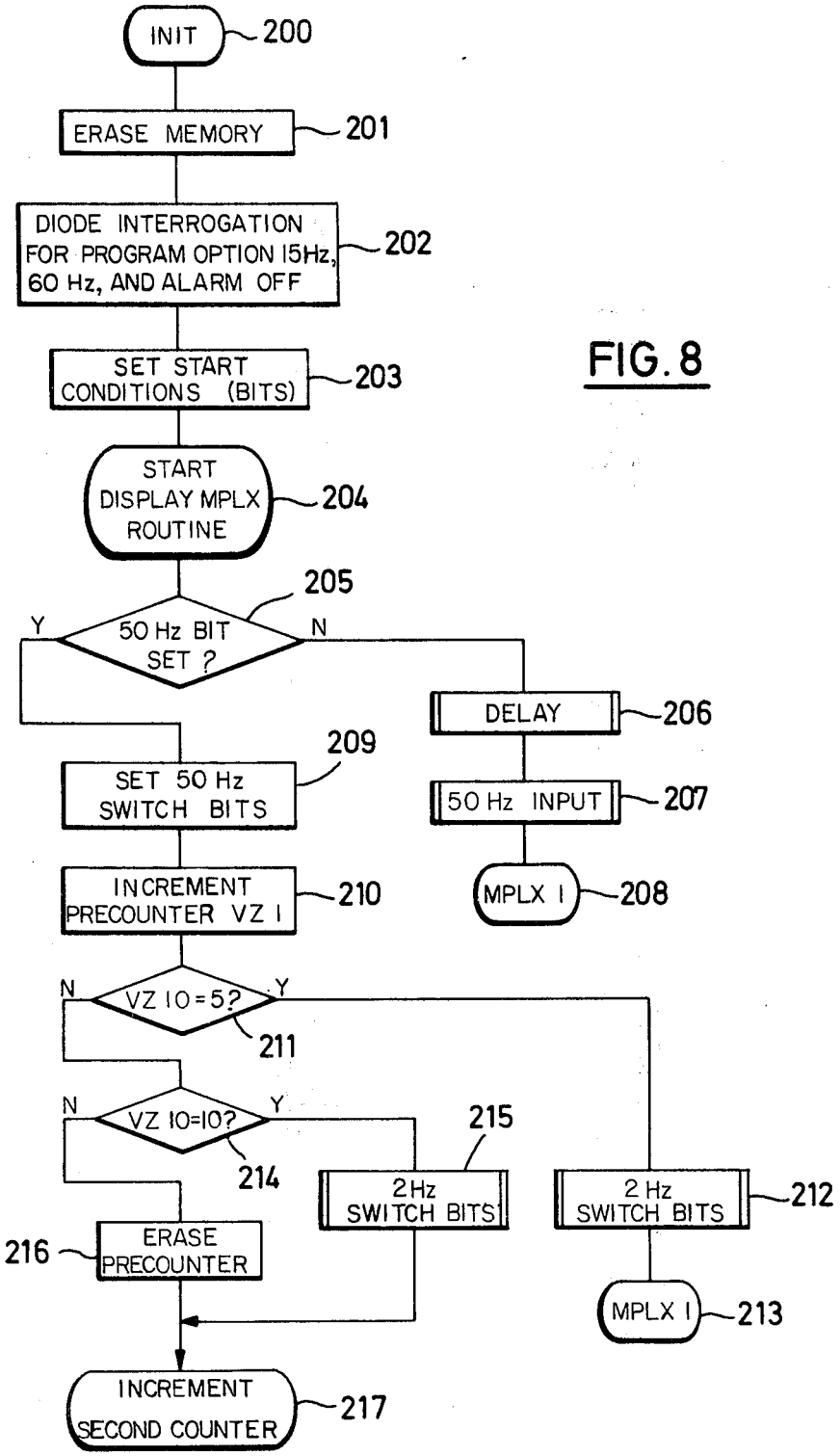
Figure 9:
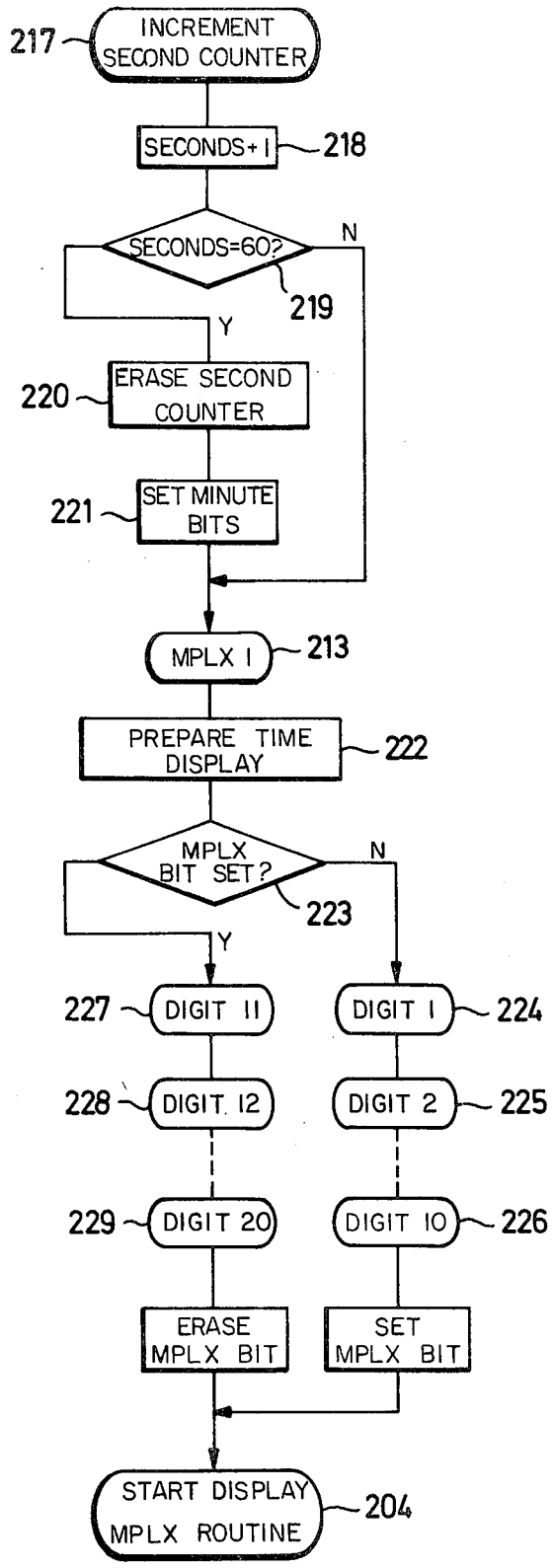
Figure 10:
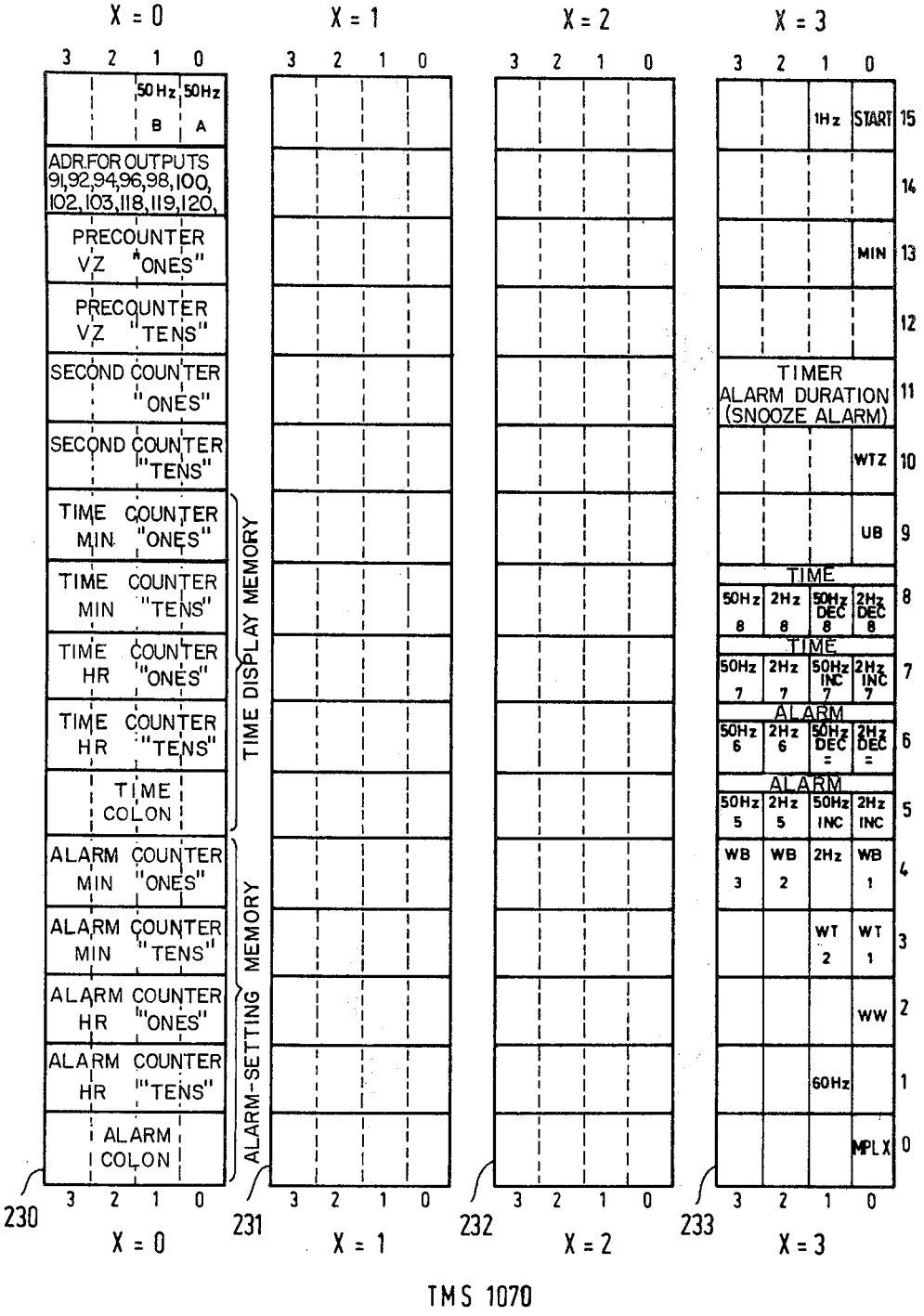
Figure 11:
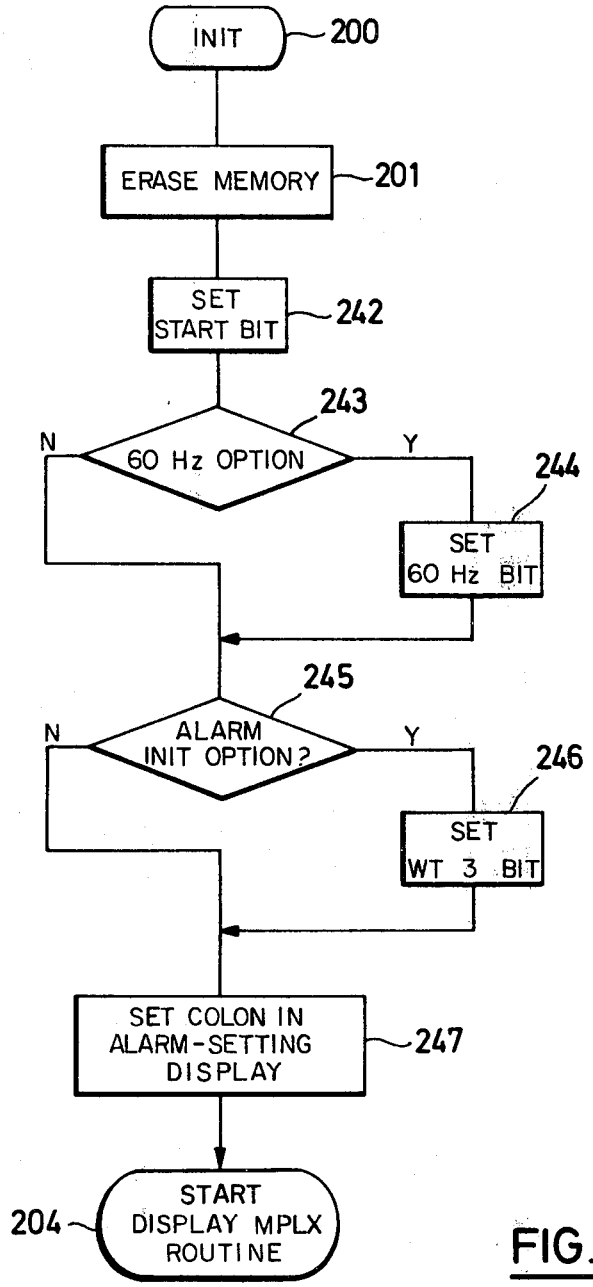
Figure 12:
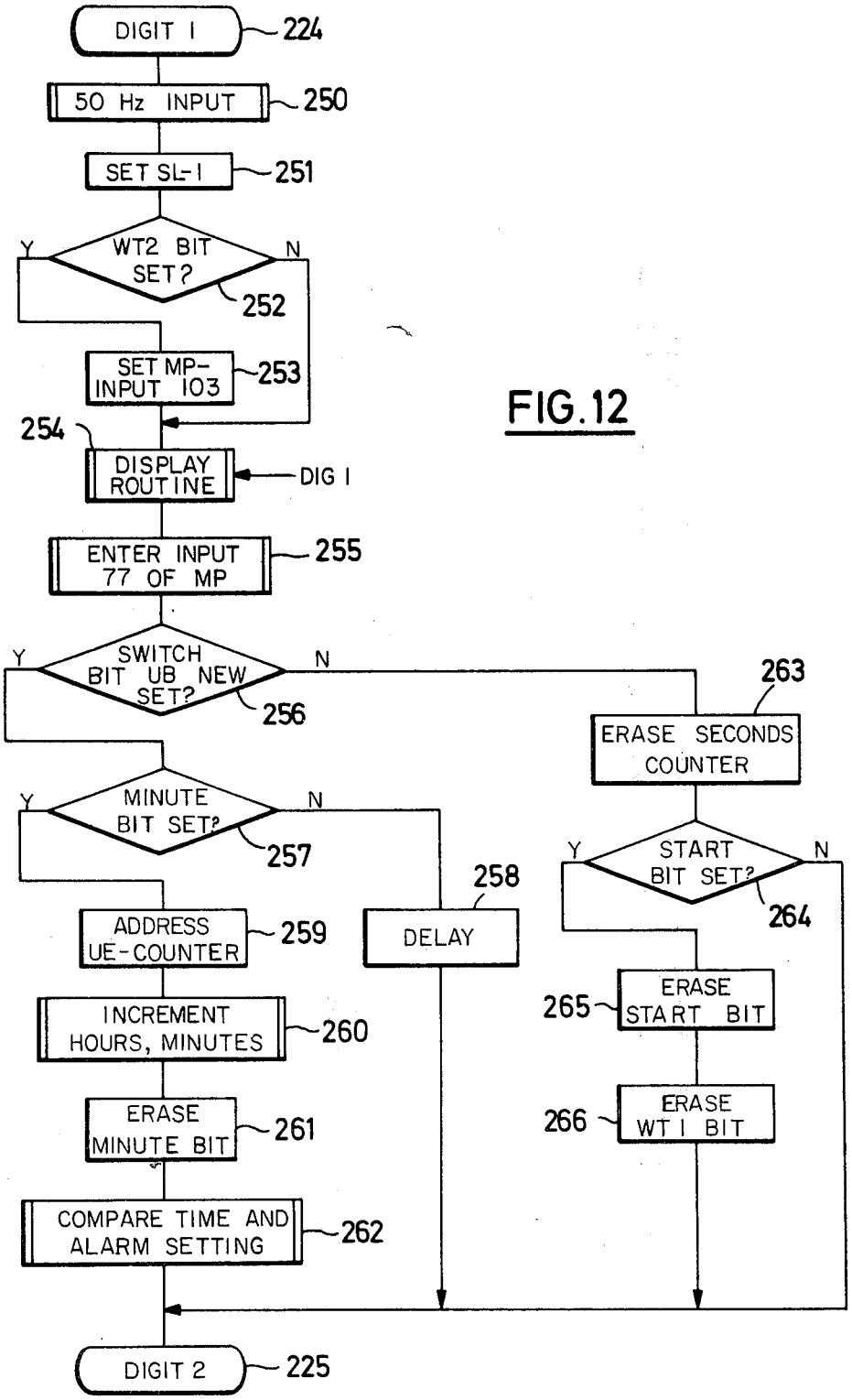

FIG. *7a* is a pulse diagram for controlling the time and alarm setting display tubes;

FIG. *7b* is a pulse diagram for controlling a buzzer, whereby this diagram is associated with the diagram shown in FIG. *7a* and comprises a constant alternating frequency;

FIG. 8 is a first part of a main program for the microprocessor controlling the clock;

FIG. 9 is a second part of a main program for the microprocessor controlling the clock;

FIG. 10 shows the organization of the main memory;

FIG. 11 is a detailed illustration showing the first area of the first part of the main program;

FIG. 12 is a subprogram which runs essentially during the time a display digit is lit.

Figure 1:
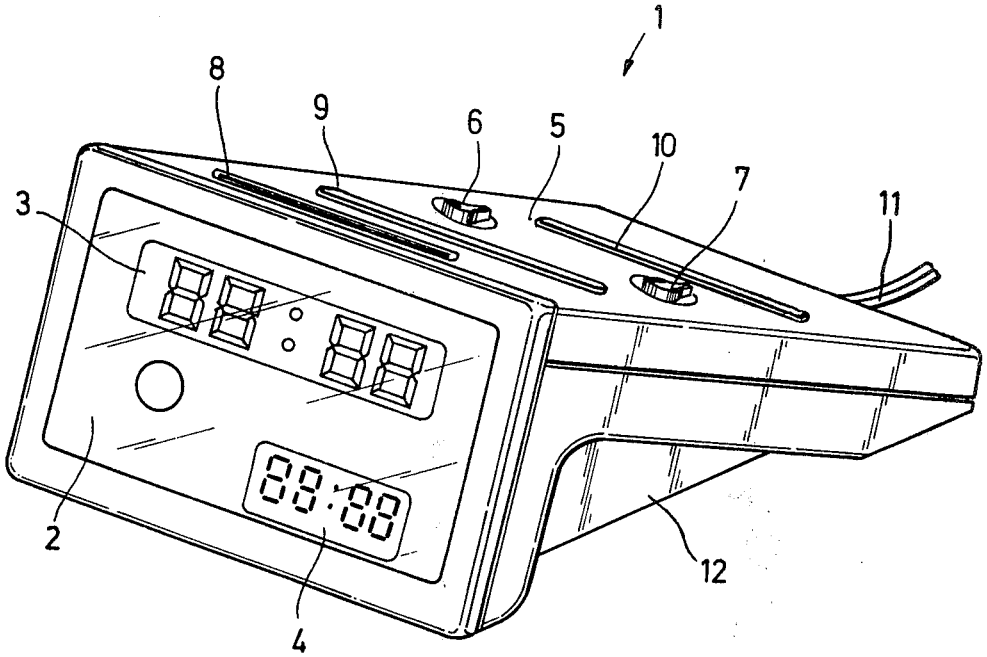
FIG. 1 is a perspective view of the clock according to the invention.

FIG. 1 is a perspective view of a clock 1, said clock having a digital display 3 for the time and a digital display 4 for the alarm setting on its front 2. Operating devices are provided on the top 5 of this clock 1, said devices serving to set or call up various functions. A knob 6 is provided to set the time, said knob having several rotational positions. In one of these rotational positions, for example, the time is set at a first speed, while the time setting takes place at a second speed at another rotational position. A second knob 7 is provided to set the alarm, said knob likewise permitting two different setting speeds. The setting process itself takes place in known fashion by a clock generator or the like advancing the digits of displays 3 and 4, composed of segments. The various times can be set by running the clock either forward or backward. To allow setting the time with an accuracy of one second, the next full minute is set and knob 6 set to "stop." When the desired time is reached, the knob is switched to "run."

A sensor button 8 is provided in the vicinity of the front 2, on the top 5 of clock 1, said button 8 serving to initiate a snooze cycle. The snooze interval can be 10 minutes, and can be repeated five times. When the alarm setting is reached, an acoustic signal sounds, which is interrupted by touching sensor button 8. After 10 minutes, the buzzer sounds again, and can once again be interrupted by touching sensor button 8. This is followed by another pause of 10 minutes, and so forth. The entire process can be repeated a total of five times or as often as desired.

Mechanical button 9 is located beneath sensor button 8 and is used for a 24-hour alarm. Pressing this button turns off the alarm for 24 hours. Display 4 stays on.

Another mechanical button 10 is located beneath knobs 6 and 7, said button turning off the alarm completely when pressed. Display 4 goes out in this case. To turn it on again, button 10 must be pressed again. Displays 3 and 4 of clock 1 each contain four 7-segment digits designed as active radiators, said digits being supplied with electrical power through a line cable 11. Although the clock 1 shown in FIG. 1 is designed to run on line voltage, it is possible in principle to design it as a battery-powered clock. The electrical and electronic components required to operate clock 1 are essentially located in a bulge 12 located beneath top 5.

Figure 2:
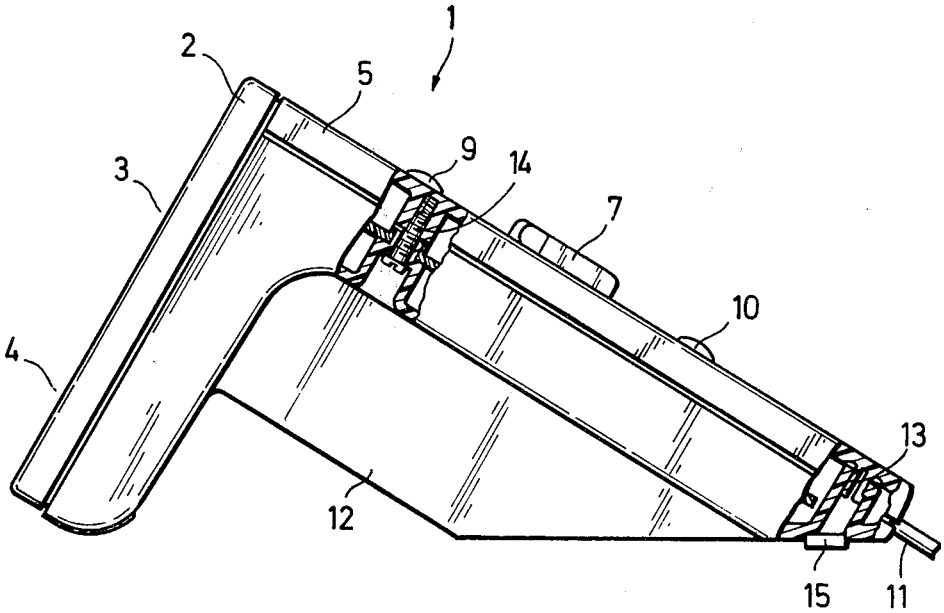
FIG. 2 is a side view of the clock shown in FIG. 1.

FIG. 2 shows clock 1, shown in FIG. 1, once again from the side, whereby clock 1 is cut away at two points. This drawing again shows front 2 with displays 3 and 4 as well as top 5 with buttons 9 and 10 and knob 7. The cutaway areas show, on the one hand, a snap connection 13 and, on the other hand, a screw connection 14 between bulge 12 and the upper part 5 of clock 1. A foot 15 to support the clock is provided beneath snap connection 13.

Figure 3:
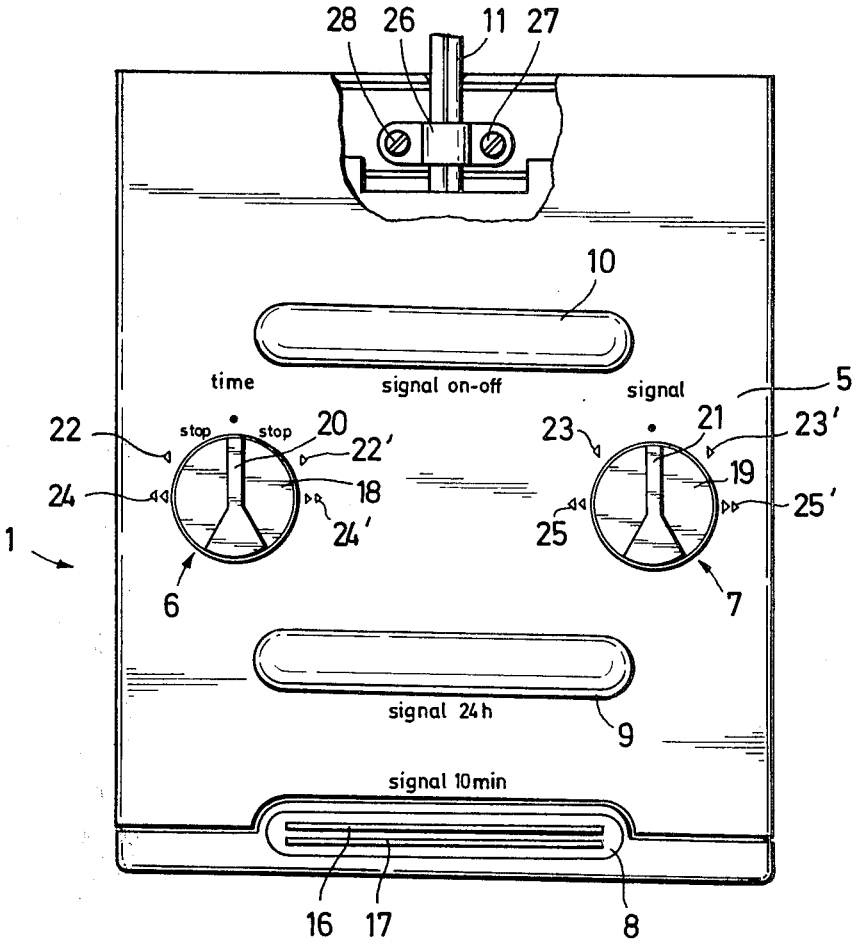
FIG. 3 is a top view of the clock shown in FIG. 1.

FIG. 3 is a top view of clock 1, whereby the individual operating elements can be seen. Sensor button 8 has two electrical contact strips 16 and 17, which can be bridged by touching them with a finger, thus turning off the alarm. Buttons 9 and 10 are elongated and rounded at the corners. Knobs 6 and 7, on the other hand, have circular tops 18 and 19 and are provided with Y-shaped raised areas, 20, 21 on these tops. Arrow symbols 22 and 23 show the positions of knobs 6 and 7, in which the time and alarm setting can be changed slowly in a first direction. Arrow symbols 22' and 23' indicate slow adjustment in a second direction. Arrow symbols 24, 25, 24', and 25' on the other hand indicate rapid setting in a first or second direction.

Attachment of line cable 11 to the clock housing by means of a clamp 26 and two screws 27, 28 cn be seen at the point where clock 1 is cut away in FIG. 3.

Figure 4:
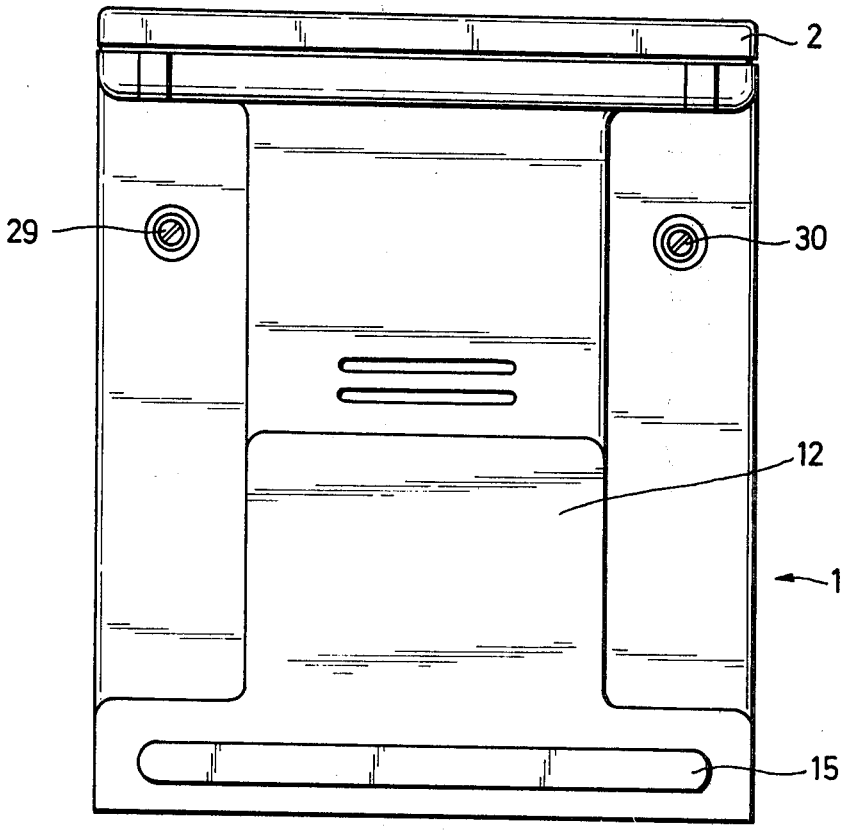
FIG. 4 is a view of the bottom of the clock shown in FIG. 1.

FIG. 4 shows the bottom of FIG. 1. This drawing shows that the top and front 2 and 5 of clock 1 are much wider than the middle part of bulge 12. Two screws 29 and 30 are shown which serve to connect the bottom part of clock 1 with the top part.

Figure 5:
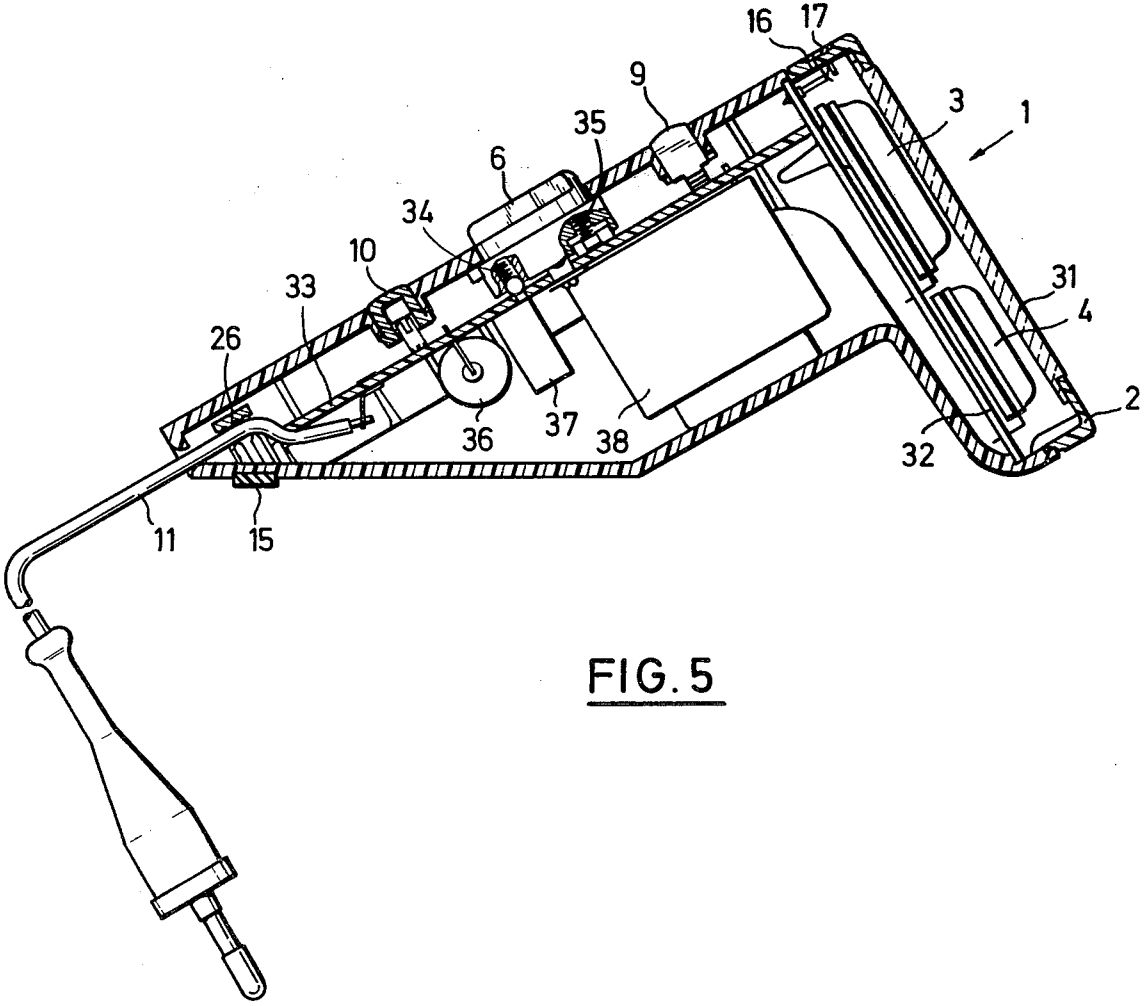
FIG. 5 is a cross section though the clock shown in FIG. 2.

FIG. 5 shows clock 1, like FIG. 2, from the side, but in a cutaway view. Once again a front panel 31 can be seen, located in front of display 3 for the time and display 4 for the alarm setting. These displays are mounted on a support panel 32, said panel being mounted in turn on the clock housing. Another panel 33 is provided at right angles to support panel 32, said panel 33 providing a point of support for the opposing forces acting upon buttons 9 and 10 and knobs 6 and 7. Note that not only buttons 9 and 10 but also knobs 6 and 7 with springs 34 and 35 are supported. Electrical and electronic components are represented by 36, 37 and 38, serving to derive time signals from the line frequency and to drive displays 3 and 4. These displays 3 and 4 can be, for example, Futaba fluorescent displays of the 4-BT-07 type, for the alarm setting, and the 4-LT-11 type for the time, made by Futaba Corporation, Daido Keori Bldg., 3F, 3-1-16, Satokanda, Chiyoda-ku, Tokyo 101, Japan.

Figure 6:
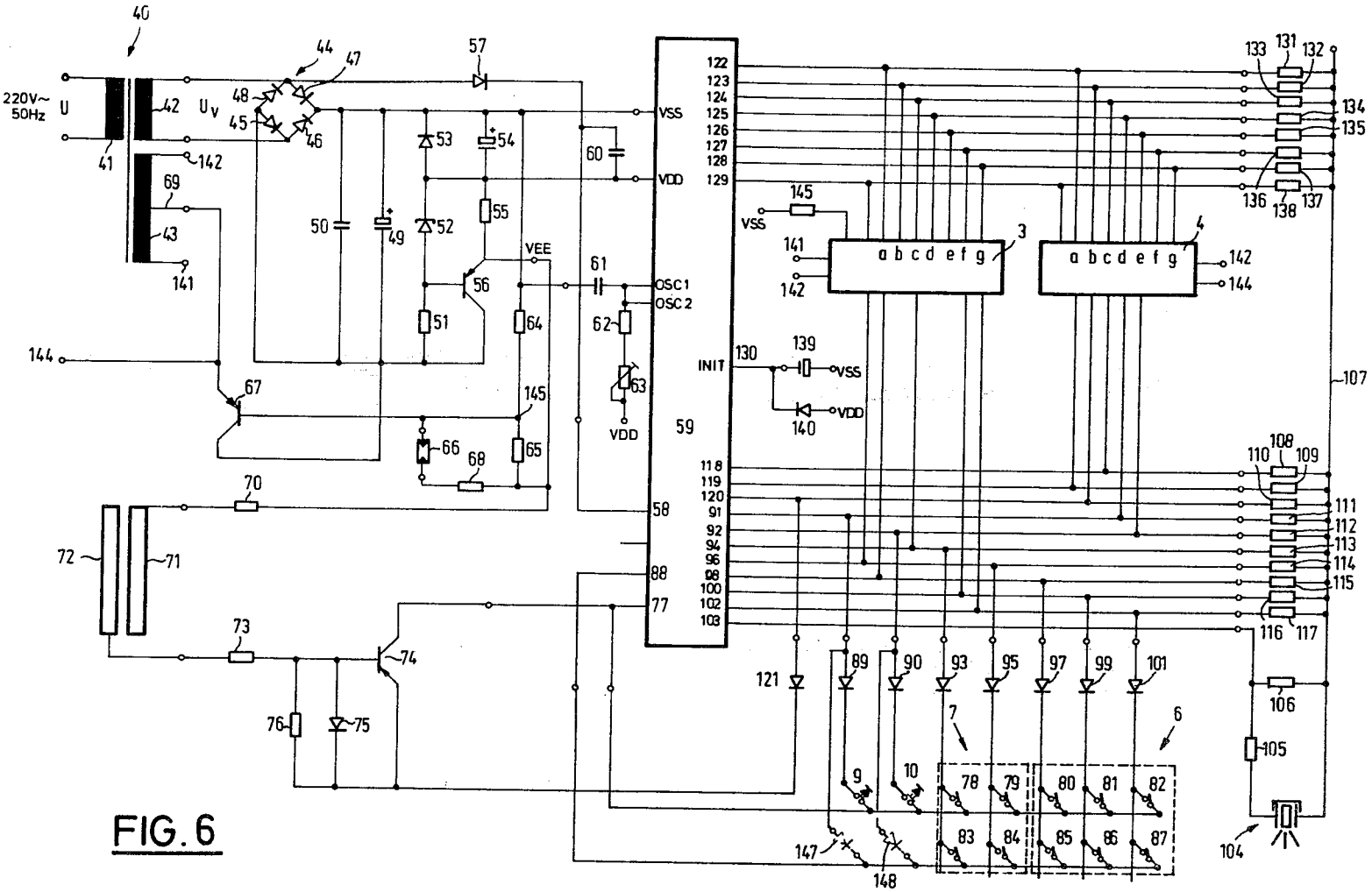
FIG. 6 is a schematic diagram of the clock according to the invention.

FIG. 6 is a schematic digram of the circuit which operates the clock. In the diagram, 40 is a line transformer, whose primary winding 41 is connected for example to 220 V, 50 Hz. This line transformer comprises a secondary winding 42 and a tertiary winding 43, whereby the output of secondary winding 42 is connected to a Grätz bridge rectifier 44 with four diodes 45, 46, 47, and 48. The D.C. voltage supplied by this bridge is fed to a storage capacitor 49, in the form of an electrolytic capacitor, which therefore has a certain inductance. To ensure reliable filtration, therefore, an additional capacitor 50 is provided, connected in parallel with capacitor 49. A serires circuit composed of a resistor 51, a first Zener diode 52, and a second Zener diode 53 is connected in parallel with this capacitor 49, whereby a capacitor 54 is provided in parallel with the second Zener diode 53, said capacitor 54 serving for filtration. A resistor 55 is connected to the anode of Zener diode 53, said resistor having its other lead connected to the emitter of a transistor 56. The base of this transistor 56 is connected to the lead between the anode of Zener diode 52 and one lead of resistor 51, while the collector of this transistor 56 is connected to the other lead of resistor 51 and hence to Grätz bridge 44. The voltage $U_V$ is fed through a diode 57 to a terminal 58 of a microcomputer 59, which can be for example a TMS 1070 microcomputer or microprocessor. Similarly, supply voltage $U_V$ is fed through diode 57 and a capacitor 60 to an input $V_{DD}$ on microcomputer 59.

Trimmers for the oscillator, whose active elements are provided in microprocessor 59, are applied to two other inputs OSC 1 and OSC 2 of microcomputer 59. These trimmers consist essentially of an RC element, which in this specific example is composed of capacitor 61 and two resistors 62 and 63, with resistor 63 being adjustable and connected to a voltage $V_{DD}$. Capacitor 61 is connected to input $V_{SS}$ and the first lead of a resistor 64, while its second lead is connected to another resistor 65, and the two resistors 64 and 65 form a voltage divider, to whose center tap a photosensitive resistor 66 is connected. This photosensitive resistor is connected, on the one hand, to the base of a transistor 67 and, on the other hand, to a resistor 68, said resistor 68 also being connected to the emitter of transistor 56. The emitter of transistor 67 is connected to a center tap 69 of the tertiary winding 43, while its collector is connected with capacitor 49 or the collector of transistor 56, both 49 and 56 being connected to a D.C. terminal on Grätz bridge 44.

A connection to a first sensor contact 71 runs via a resistor 70 from the emitter of transistor 56, which is at potential $V_{EE}$. A second sensor contact 72 is located opposite this first sensor contact 71, said contact 72 in turn being connected via a resistor 73 to the base of a transistor 74. A diode 75 and a resistor 76 are connected in parallel with the base-emitter lead of this transistor 74, while the collector of transistor 74 is connected to a terminal 77 on microcomputer 59. The 24-hour alarm button 9, weekend alarm button 10 and knobs 6 and 7 are also connected to this terminal; however, knobs 6 and 7 are connected only when they are in the positions which are symbolized by switches 78, 79, and 80, 81, 82. The knobs are connected to a terminal 88 in positions symbolized by switches 83, 84 and 85, 86, 87. Buttons 9 and 10 are connectable via diodes 89 and 90 with outputs 91 and 92 of microcomputer 59, while switches 78 and 83 are connected via a diode 93 with output 94, switches 84 and 79 are connected via a diode 95 with an output 96, switches 80, 85 are connected via a diode 97 and an output 98, switches 81 and 86 are connected via a diode 99 with an output 100, and switches 82, 87 are connected via a diode 101 with an output 102 of the microcomputer. Diodes 89, 90, 93, 95, 97, 99, and 101 are connected, observing polarity, so that their anodes are connected with outputs 91, 92, 94, 96, 98, 100, and 102. Diode 75 serves to reduce the voltage when high electrostatic voltages are present.

A piezoelectric buzzer 104 is connected via a resistor 105 with another output 103 of microcomputer 59. A discharge resistor 106, connected on the one hand with output 103 and on the other hand with a lead 107, is connected in parallel with a series circuit composed of resistor 105 and buzzer 104, where several "pull down" or bleeder resistors 108 to 117 are connected. The other leads of these resistors 108 to 117 are connected to outputs 118, 119, 120, 91, 92, 94, 96, 98, 100, 102, and 103 of microcomputer 59. A diode 121 with its anode is connected to output 120, whereby its cathode is connected to the emitter of transistor 74.

Microcomputer 59 has additional outputs 122 to 129, said outputs being connected by resistors 131 to 138, respectively, to lead 107.

An output 130 is also provided to which a capacitor 139 and a diode 140, with its cathode, are connected, whereby capacitor 139 has its second lead at potential $V_{SS}$, while the diode has its anode at potential $V_{DD}$.

The digits of digital display 3 to show the time are connected to outputs 122 to 128 of microcomputer 29. The corresponding leads of display 3 are designated a–g.

Similarly, digital display 4 for the alarm setting is connected to outputs 122 to 128.

The potential at point 142 of tertiary winding 43, like the potential at point 141 on this winding 43, is supplied to displays 3 and 4.

Similarly, leads run from outputs 94, 96, 98, and 100 of microcomputer 59 to display 3 and from outputs 118, 119, 120, 91, and 92 of this microcomputer 59 to display 4.

The leads which run to the terminals of displays 3 and 4 designated a–g are connected to the anodes of luminescent tubes, not shown in greater detail, while leads 141, 142, 144 run to the hot-filament cathodes and the outputs 94, 96, 98, and 100 as well as 118, 119, 120, 91, and 92 run to the grids of the tubes.

The circuit connected to line transformer 40 is designed essentially to provide microcomputer 59 with the correct and possibly stabilized voltage. It is important to note in this regard that voltage $V_{SS}$–$V_{DD}$ must always be kept constant because of the design of microcomputer 59. On the other hand, it is merely necessary to limit voltage $V_{SS}$–$V_{EE}$. Hence, when input voltages are at the rated value or above, the circuit must regulate both voltage $V_{SS}$–$V_{DD}$ and voltage $V_{SS}$–$V_{EE}$. On the other hand, if the input voltage drops off relatively sharply, at least voltage $V_{SS}$–$V_{DD}$ must be regulated, while voltage $V_{SS}$–$V_{EE}$ can be allowed to drop because this will merely result in a decreased brightness of displays 3 and 4. The current which normally flows in the direction of $V_{SS}$ is much less than the current that flows through $V_{EE}$, for example 10 mA instead of 30 mA.

At normal input voltages, e.g., 39 V, the abovementioned voltages are regulated by Zener diodes 52 and 53, with resistor 51 acting as a current limiter. Transistor 56 is then used as an emitter follower. On the other hand, if the input voltage at capacitor 49 drops off sharply, for example from 39 V to 35 V, the Zener diode 52 will no longer conduct because of its characteristic. Since transistor 56 still operates as an emitter follower, the current will no longer flow through diodes 53, 52, and resistor 51, but through diode 53, resistor 55 and transistor 56. The necessary voltage $V_{SS}$–$V_{DD}$ is maintained at diode 53. Thus, good voltage regulation can be achieved in simple fashion by employing a simple, inexpensive transistor 56.

In designing sensor button 8, comprising the two sensor contacts 71 and 72, it is important to note that the components will not be destroyed if, for example the operator touches only one of sensor contacts 71, 72 with a finger that carries an electrostatic charge. Although the alarm can only be shut off as a rule by both sensor contacts 71 and 72 being connected electrically with one another, it is also possible to interrupt the alarm by touching only one sensor contact.

Displays 3 and 4, as mentioned earlier, operate with time-division multiplexing: FIG. *7a* shows the scanning cycle of the display once again, in pulse form. Various pulses I—IX can be seen on the time axis, with the reference numbers of the corresponding outputs of microprocessor 59 written in. These outputs 102, 100, 98, 96, 94, and 92, 91, 120, 119, and 118 successively drive the grids of the fluorescent-tubes in displays 3 and 4. The pulse widths of pulses I–V are approximately three times larger than the pulse widths of pulses VI–X producing a good duty factor. Specifically, this advantageous duty factor is achieved by the smaller display digits showing up three times brighter for a given pulse width than the large digits. With equal brightness, consequently, the pulses for the small digits can be made three times smaller than the pulses for the large digits.

The large digits of time display 3 are therefore driven for a longer period of time than the small digits in alarm setting display 4.

Output 102, i.e., pulse I, drives the "ones" of the minutes in the time display 3, while pulse II drives the "tens" of these minutes.

Similarly, the "ones" in the hours are driven by pulse III and the "tens" in the hours are driven by pulse IV.

The alarm setting display 4 is driven similarly, with pulses VI and VII driving the "ones" and "tens" of the minutes and pulses VIII and IX driving the "ones" and "tens" of the hours.

Pulses V and X drive the colon between the minute and hour digits.

FIG. *7b* shows on the time axis, how the pulses for the alarm run relative to the scanning pulses shown in FIG. *7a*. It is evident that the buzzer frequency is linked to the scanning cycle.

Notations DIG 1–DIG 10 are provided via pulses I–X of FIG. *7a*. These notations refer to program parts which run during the scanning cycle. Additional program parts DIG 11–DIG 20 are indicated beneath pulses I–X, indicating that different parts of a program can be called up during two scanning cycles. A gap appears at the end of the last scanning pulse X, whereupon scanning pulse I reappears. It is obvious to use this gap to implement all additional program steps after scanning all the digits in a display 3 or 4. However, this would result in a deterioration of the duty factor. Hence, according to the invention, the program parts are called up not only in the gap but also in pulses I–X.

The program flow is shown in greater detail on the flowchart in FIG. 8. It is clear from this figure that following startup, indicated by start block 200, the memory of microprocessor 59 is erased. This is done so that any stored data that could cause the display of incorrect times or alarm settings, are erased. This erasure is represented by block 201. Then diodes 147 and 148 are interrogated in 202 for the program option. If diode 148 is connected, the line frequency is 60 Hz. If diode 147 is connected, it means that the alarm will not go off following a line voltage outage. The starting conditions are set in 203, i.e., the start bit, the diode bits, the alarm, etc.

At 204, the program begins with the multiplex routine for displays 3 and 4. At the end of this routine, an inquiry is made at 205, whether the 50 Hz bit is occupied. If this is not the case, a delay subroutine 206 is cut in, which then permits a 50 Hz input subroutine 207 to run. The system then returns to multiplex routine 208.

If, on the other hand, a 50 Hz bit is set, the 50 Hz switch bit is set at 209, and the precounter VZ 1 of the "ones" is incremented at 210. An inquiry is then made at 211, whether the precounter of the "tens" is equal to "five." If this is the case, the subroutine at 212 runs for the 2 Hz switch bits. Then the system runs through the multiplex routine at 213. If the precounter of the tens is not on "five," an inquiry is made at 214 whether the precounter for the tens is on "ten." If this is the case, the subroutine for the 2 Hz switch bits then runs at 215. Otherwise, the precounter is erased at 216 and the seconds counter at 217 is incremented.

Figures 7A, 7B:
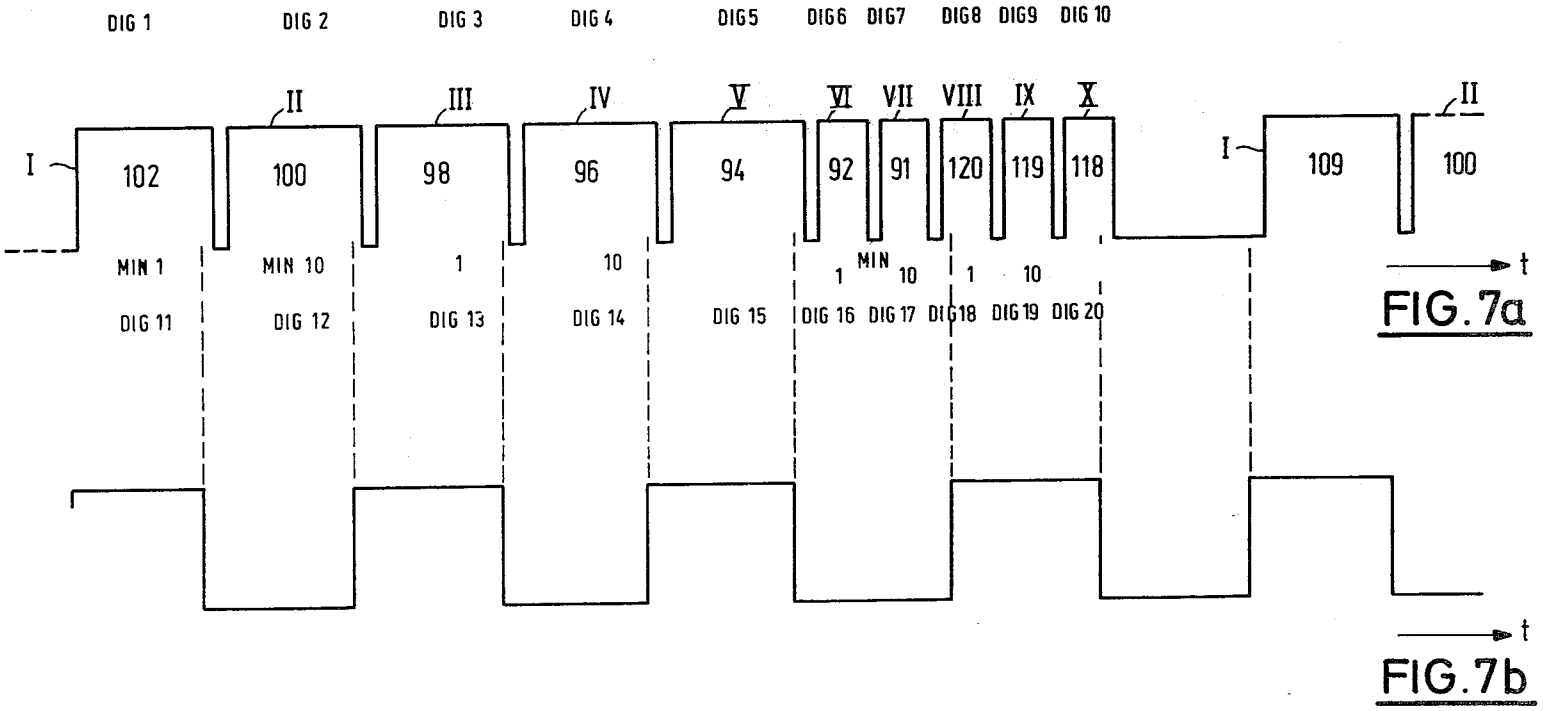

FIG. 9 shows a flowchart which is a continuation of the flowchart shown in FIG. 8. The system is incremented by one second at 218 and then interrogated at 219, whether the second setting is "sixty." If this is not the case, the system switches to multiplex. However, if the second setting is "sixty," the seconds counter at 220 is erased and the minute bit is set at 221. The time display is then prepared at 222, and an inquiry is made at 223 whether the multiplex bit is set. If this is not the case, digits 1 to 10 at 224, 225, and 226 (see also the top row in FIG. 7*a*) are allowed to run, while, if this is the case, digits 11 . . . 20 (see the bottom row in FIG. 7*a*) at 227, 228, and 229 are called up. At the end of digit 10, the multiplex bit is set, while the multiplex bit at the end of digit 20 is erased. The system then switches to routine 204, which is the start of the multiplex display.

FIG. 10 shows the organization of the memory (RAM) of microprocessor 59 in greater detail. The expressions x=0, x=1, x=2, and x=3 are the x coordinates of the four-bit registers 230–233. The y coordinates of the registers are listed on the right-hand side and numbered 0–15. Thus, we have a memory with 16 four-bit words. Only two of the four registers are required for the clock according to the invention; the two middle registers, x=1 and x=2, are therefore unoccupied.

The contents of left-hand register x=0 are largely indicated by the expressions used in FIG. 10.

After the organization of the main memory is known in principle, the first part of the main program shown in FIG. 8 is shown once again in FIG. 11.

It is clear from this figure that blocks 202 and 203 of FIG. 8 can be implemented by several individual processes 242–247.

The main program in FIGS. 8 and 9 comprises numerous subroutines or subprograms, which are not shown or discussed in detail. In part, these subprograms are governed solely by the microprocessor used (the Texas Instruments TMS 1070), and can be eliminated or can be different if another microprocessor is used.

A subprogram "DIGIT 1" is shown in greater detail in FIG. 12, solely as an example. As outlined above, this is a part of the program that essentially runs when the first digit of the time display is operating (see FIG. 7*a*, upper half), i.e., when control pulse 1 is present.

The running of the "DIGIT 1" part of the program is readily apparent from the labelling of the original blocks 250–266. The points at which the special subprograms branch off are marked by boxes with two parallel vertical lines in them.

The "DIGIT 2" to "DIGIT 10" and "DIGIT 11" to "DIGIT 20" parts of the program run in the same way as the "DIGIT 1" part. The important advantage which nesting the DIGIT program parts in control pulses provides, consists in the fact that not only the gaps between 118 and 109 (FIG. 7*a*) are available for processing the program. If these gaps were provided only for the total program, they would have to be enlarged, in other words, only shortened pulses would remain to drive the display digits, resulting in a reduction of brightness.

It is understood that the invention is not limited to the embodiments described hereinabove; rather, it can be varied considerably. Thus, for example, it is possible to use a different arrangement for the diode 75 that serves to limit the voltage, namely, by connecting a resistor 76 parallel to the base-emitter lead of transistor 74 and connecting diode 75 to $V_{SS}$ from the base of transistor 74. Other variations, such as the redesign of the Y-shaped knob in the rotary switch to resemble a conventional alarm setter, are also available.

While the invention has been described by way of a preferred embodiment, various substitutions of equivalents may be effected which do not depart from either the spirit or scope of the invention as set forth in the appended claims.

What is claimed as new and desired to be secured by Letters Patent of the United States is:

1. In an electronic clock provided with an alarm mechanism and capable of simultaneously displaying by electro-optical display means both a current time setting and an alarm time setting, that improvement which comprises:

first adjustment knob means for electronically adjusting said current time setting selectively either forward or backward at a selective plurality of predetermined rates by actuating said first adjustment knob means to one of a provided plurality of current time setting positions; and second adjustment knob means for electronically adjusting said alarm time setting selectively either forward or backward at a selective plurality of predetermined rates by actuating said second adjustment knob means to one of a provided plurality of alarm time setting positions;

whereby a single knob provides convenient and rapid one-handed setting said current time and a single knob provides convenient and rapid one handed setting of said alarm time.

2. A clock as in claim 1, wherein said first adjustment knob means is provided with a first setting position for advancing said current time setting at a first speed, a second setting position for advancing said current time setting at a second speed, a third setting position for setting said current time setting backward at a third speed and a fourth setting position for setting said current time setting backward at a fourth speed, and wherein said second adjustment knob means is provided with a first setting position for advancing said alarm time setting at a first speed, a second setting position for advancing said alarm time setting at a second speed, a third setting position for setting said alarm time setting backward at a third speed and a fourth setting position for setting said alarm time setting backward at a fourth speed.

3. A clock as in claim 1, further comprising:

microprocessor control means for controlling the functions of said clock; and

DC power supply means, including a rectifier and a regulating circuit, for supplying said microprocessor with stabilized DC voltage from an alternating source;

said regulating circuit including means for producing a first substantially constant voltage maintained within a specific range, said second voltage being limited only when a predetermined threshold value is exceeded.

4. A clock according to claim 3, wherein said regulating circuit includes a first Zener diode having an anode and a cathode, said cathode being connected to a first terminal of said rectifier and said anode being connected through a second Zener diode and a first resistor to a second terminal of said rectifier, and wherein said first voltage is supplied at said first Zener diode.

5. An electronic clock as in claim 4, further comprising:

a transistor having an emitter and a base;

a capacitor and a second resistor connected in series between said cathode of said first Zener diode and said emitter of said transistor;

said base of said transistor being connected to said anode of said second Zener diode; and said means for supplying said second voltage being connected between said cathode of said first Zener diode and said emitter of said transistor.

6. A clock according to claim 1, wherein said current time setting display and said alarm time setting display include light-emitting elements and further comprising brightness control means for controlling the brightness of said current time and alarm time setting displays by varying the voltage supplied to said displays, said brightness control means including a voltage regulator having a transistor and a photoresistor, said photoresistor having a relatively low resistance when the ambient light intensity is relatively high and a relatively high resistance when the ambient light intensity is relatively low, and further including first, second and third resistors forming a voltage divider circuit with said photoresistor and said transistor, said display brightness being determined essentially by said first and second resitors when the ambient light intensity is high and being essentially determined by said first and third resistors when the ambient light intensity is relatively low.

7. A clock according to claim 1, wherein said alarm mechanism may be armed to be activated upon coincidence of said current time setting and said alarm time setting, and further comprising first pushbutton means for deactivating said alarm mechanism without disarming said alarm mechanism and without erasing said alarm time setting display, such that said alarm mechanism will again become activated upon the next subsequent coincidence between said settings.

8. A clock as in claim 1, further comprising second pushbutton means, a first actuation of which during the sounding of said alarm mechanism silences and disarms said alarm mechanism and erases said alarm time setting display, and wherein a second actuation of said button following said first actuation rearms said alarm mechanism and reactivates said alarm time setting display.

9. A clock according to claim 8, further comprising contact means for silencing said alarm mechanism for a predetermined time period, said contact means including two electrically conductive contact strips adapted to be bridged by a user's finger.

10. A clock as in claim 2, further comprising a circuit addressable by said microprocessor, said addressable circuit including means for connecting and disconnecting at least one diode to and from a given address of said addressable circuit, and means for varying the operation of said microprocessor in accordance with the presence or absence of said diode at said given address.

* * * * *